US007073629B2

(12) United States Patent
Gardner et al.

(10) Patent No.: US 7,073,629 B2
(45) Date of Patent: Jul. 11, 2006

(54) LADDER SUPPORT APPARATUS AND METHODS

(75) Inventors: Richard J. Gardner, Brier, WA (US); Karl J. Schaefer, Everett, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/788,211

(22) Filed: Feb. 26, 2004

(65) Prior Publication Data

US 2005/0189175 A1 Sep. 1, 2005

(51) Int. Cl.
*E06C 7/00* (2006.01)

(52) U.S. Cl. ..... 182/180.2; 182/108

(58) Field of Classification Search ..... 182/107, 182/108, 200, 180.1, 180.2
See application file for complete search history.

(56) References Cited

U.S. PATENT DOCUMENTS

| | | | | |
|---|---|---|---|---|
| 1,651,863 | A * | 12/1927 | Baur | 182/200 |
| 2,743,049 | A * | 4/1956 | Flesher | 182/176 |
| 4,244,446 | A | 1/1981 | Mair | |
| 4,655,322 | A | 4/1987 | Mittanck | |
| 5,704,451 | A * | 1/1998 | King | 182/204 |
| 6,655,497 | B1 * | 12/2003 | Weatherall | 182/108 |

* cited by examiner

*Primary Examiner*—Alvin Chin-Shue
(74) *Attorney, Agent, or Firm*—Lee & Hayes, PLLC

(57) ABSTRACT

Ladder support apparatus and methods are disclosed. In one embodiment, a support assembly adapted for use with a ladder includes at least one elongated member adapted to extend between first and second legs of the ladder when the ladder is positioned in an operating position. First and second coupling assemblies are coupled to the elongated member at spaced-apart positions on the elongated member. The first and second coupling assemblies are adapted to be clampably coupled to the first and second legs of the ladder, respectively. The support assembly advantageously permits the ladder to be operated over non-uniform surfaces without permanent modification of the ladder.

9 Claims, 12 Drawing Sheets

LADDER SUPPORT APPARATUS AND METHODS

FIELD OF THE INVENTION

The present disclosure relates to ladder support apparatus, and more specifically, to support assemblies for ladders operating on a plurality of support members.

BACKGROUND OF THE INVENTION

Ladders are ubiquitous devices used in a wide variety of commercial and residential circumstances. In some applications, such as during the intermediate stages of construction of structures (e.g. houses, buildings, aircraft, etc.) it may be desirable for ladders to be used prior to the installation of a uniform floor surface. This may present a challenge because most ladders are not designed to operate in the absence of a uniform floor surface.

For example, certain painting and sealing operations on aircraft sections often involve working over open floor beams at heights requiring ladders. Due to the nature of the paint and seal process, the installation of temporary flooring may not be practical. In order to resolve this problem, step ladders have been equipped with elongated rails that have been bolted or nailed to the bottoms of the legs and which extend between and beyond the front and rear legs to serve as supports for the ladders over the open floor beams.

Although desirable results have been achieved using such prior art methods, there is room for improvement. For example, it is undesirable to permanently modify the ladder by bolting or nailing the elongated rails onto the legs for various reasons, including, for example, because the ladder is thereafter rendered unable to fold up for storage. The resulting ladder assembly thereafter requires additional storage space than unaltered ladders, and may be unsuitable for other applications in which ladders are required, such as in relatively small spaces. The transport of such ladder assemblies from one work area to another typically requires more effort than the transport of unaltered ladders. Therefore, ladder support apparatus and methods that at least partially mitigate these effects would be useful.

SUMMARY OF THE INVENTION

The present invention is directed to support assemblies for ladders operating on a plurality of support members. Apparatus and methods in accordance with the present invention may advantageously provide desired support for a ladder during operations over non-uniform surfaces (e.g. a plurality of floor beams) without permanent modification of the ladder, thereby allowing the ladder to be easily converted back to its original configuration for normal use, for transport, and for storage. These and other advantages may be achieved using embodiments of ladder support assemblies in accordance with the present invention.

In one embodiment, a support assembly adapted for use with a ladder includes at least one elongated member adapted to extend between first and second legs of the ladder when the ladder is positioned in an operating position, and first and second coupling assemblies coupled to the elongated member at first and second positions on the elongated member, the first and second positions being spaced apart, wherein the first and second coupling assemblies are adapted to be clampably coupled to the first and second legs of the ladder, respectively.

BRIEF DESCRIPTION OF THE DRAWINGS

The preferred and alternative embodiments of the present invention are described in detail below with reference to the following drawings.

DETAILED DESCRIPTION OF THE INVENTION

The present invention relates to support assemblies for ladders operating on a plurality of support members. Many specific details of certain embodiments of the invention are set forth in the following description and in FIGS. 1–17 to provide a thorough understanding of such embodiments. One skilled in the art, however, will understand that the present invention may have additional embodiments, or that the present invention may be practiced without several of the details described in the following description.

In general, ladder support assemblies in accordance with the present invention may be removably coupled to the ladder to provide a "floor" wherever it is needed, without altering the ladder itself in any way. Thus, the ladder support assembly may be coupled to the ladder when needed, such as while performing operations over open floor beams, and may be uncoupled from the ladder so that the ladder may be easily folded for transport and storage.

Figure 1:
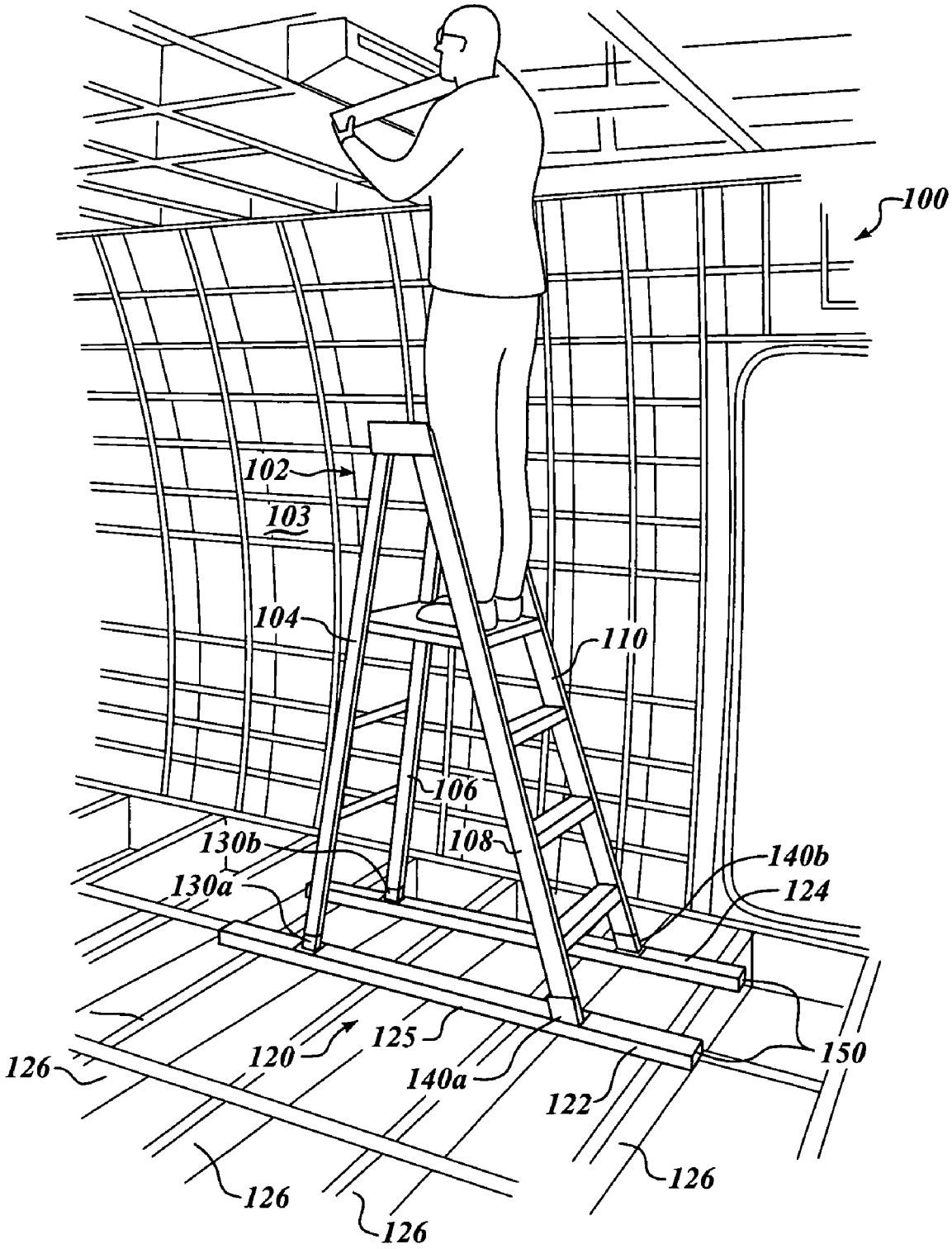
FIG. 1 is an isometric view of a ladder assembly in accordance with an embodiment of the present invention.

For example, FIG. 1 is an isometric view of a ladder assembly 100 in accordance with an embodiment of the present invention. In this embodiment, the ladder assembly 100 includes a ladder 102 having left and right front legs 104, 106, and left and right rear legs 108, 110. A ladder support assembly 120 includes a left elongated member 122 and a right elongated member 124. Left and right front coupling assemblies 130*a*, 130*b* couple the left and right front legs 104, 106 with the left and right elongated members 122, 124, and left and right rear coupling assemblies 140*a*, 140*b* couple the left and right rear legs 108, 110 with the left and right elongated members 122, 124. The left and right elongated members 122, 124 are engaged over a plurality of floor beams 126. The bottoms of the elongated members 122, 124 may coated with a layer 125 of a non-skid material, such as, for example, a spray-on polyurethane.

In the particular embodiment shown in FIG. 1, the ladder 102 is "facing" in a direction that is approximately parallel with an interior wall 103 of an aircraft during an intermediate stage of assembly. It will be appreciated that the elongated members 122, 124 are adapted to extend at least between the respective legs of the ladder 102, and preferably, to extend between and beyond the respective legs of the ladder 102 in order to span a suitable number of floor beams 126 to provide stability to the ladder 102. Thus, a user may use the ladder assembly 100 to perform certain manufacturing operations (e.g. painting and sealing operations) on the aircraft prior to the installation of temporary flooring on the floor beams 126 within the aircraft. It will be appreciated that the elongated members 122, 124 may be any type of suitable elongated members, and that the invention is not limited to the particular embodiment shown in FIG. 1. Thus, although the elongated members 122, 124 shown in FIG. 1 are formed using an aluminum channel, in alternate embodiments, the elongated members could be formed from other members and other material types, including, for example, aluminum box section extrusion, steel members, or any other suitable members.

Figure 2:
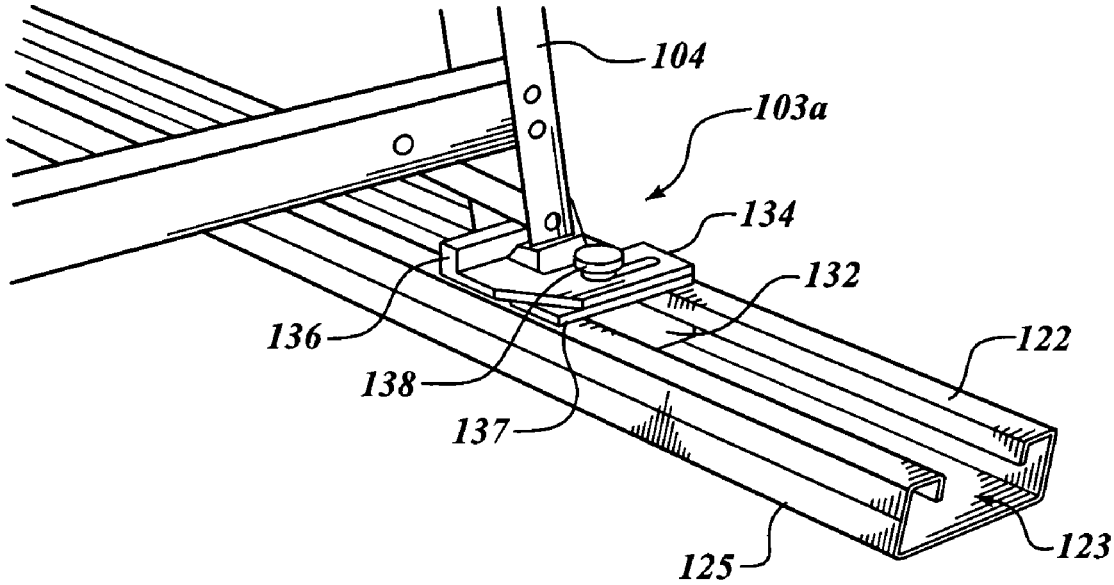
FIG. 2 is an enlarged isometric view of a left front coupling assembly of the ladder support assembly of FIG. 1.
Figure 3:
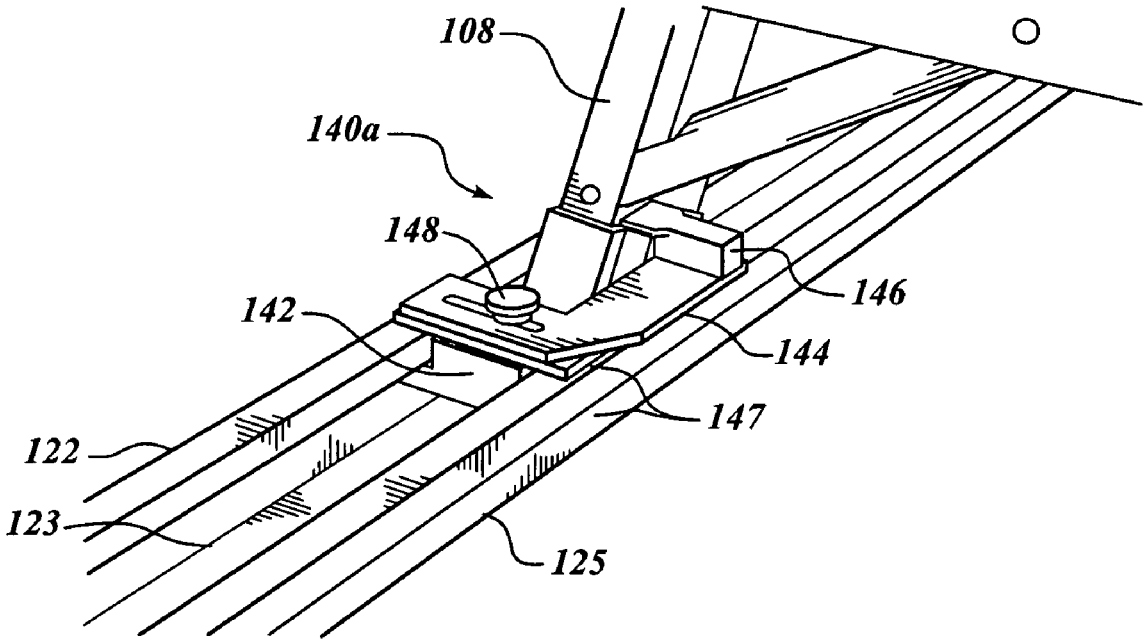
FIG. 3 is an enlarged isometric view of a left rear coupling assembly of the ladder support assembly of FIG. 1.
Figure 4:
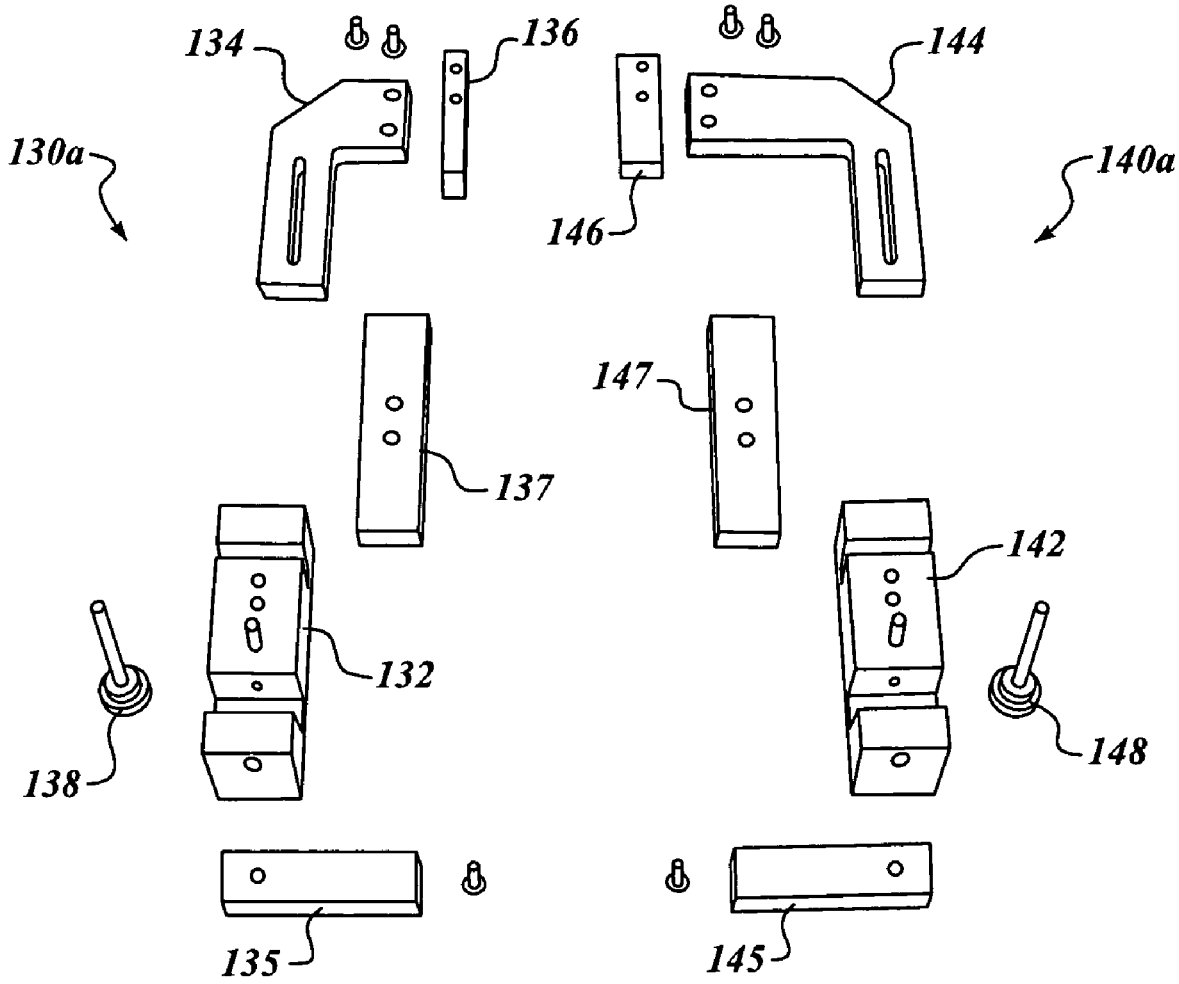
FIG. 4 is a first partially-exploded isometric view of the left front and left rear coupling assemblies of the ladder support assembly of FIG. 1.
Figure 5:
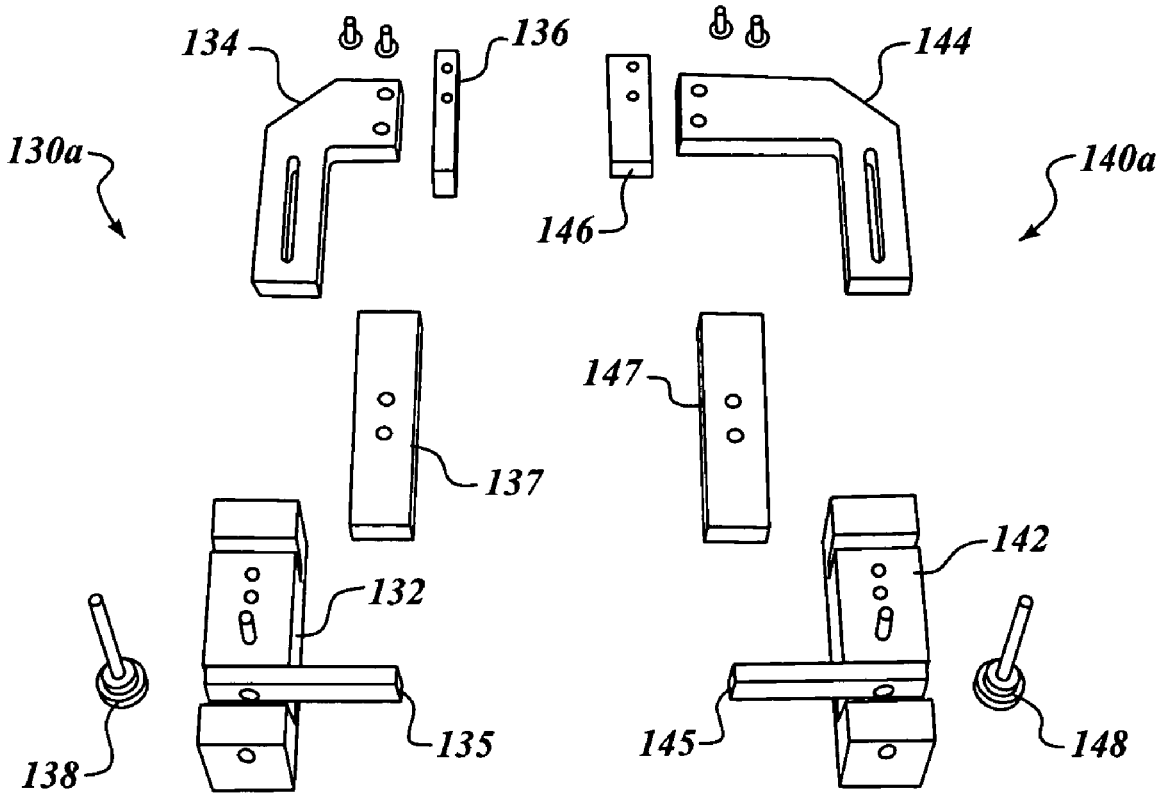
FIG. 5 is a second partially-exploded isometric view of the left front and left rear coupling assemblies of the ladder support assembly of FIG. 1.

FIGS. 2 and 3 are enlarged isometric views of the left front and left rear coupling assemblies 130*a*, 140*a* of the ladder support assembly 120 of FIG. 1. FIGS. 4–7 are partially-exploded isometric views of the left front and left rear coupling assemblies 130*a*, 140*a* of the ladder support assembly 120 of FIG. 1. In this embodiment, the left front coupling assembly 130*a* includes a slotted base 132 adapted to slideably engage into a channel 123 of the left elongated member 122 (FIG. 2). An arm member 134 is slideably coupled to the base 132, and a locking member 136 is coupled to the arm member 134 (FIG. 7). In this embodiment, the locking member 136 projects transversely at an approximately right angle away from the arm member 134.

Figure 6:
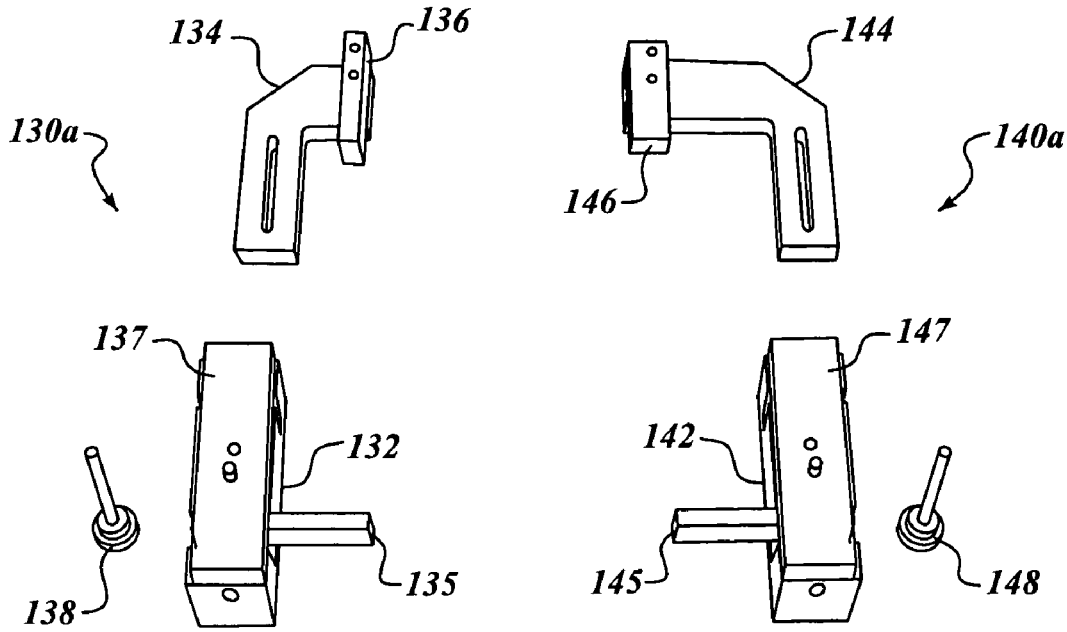
FIG. 6 is a third partially-exploded isometric view of the left front and left rear coupling assemblies of the ladder support assembly of FIG. 1.
Figure 7:
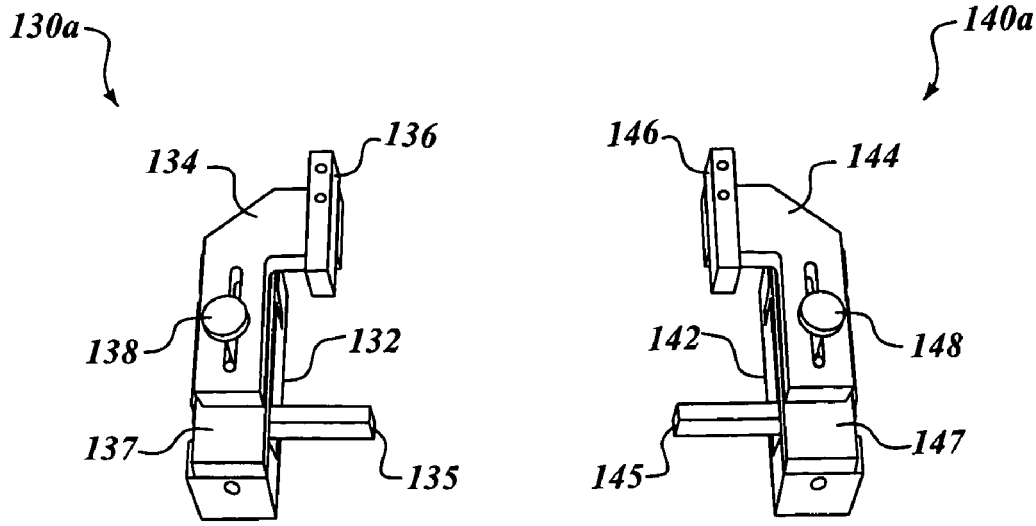
FIG. 7 is a fourth partially-exploded isometric view of the left front and left rear coupling assemblies of the ladder support assembly of FIG. 1.

As best shown in FIGS. 6 and 7, a side rail 135 projects outwardly from the base 132 along the length of the channel 123. A top rail 137 is engaged over an upper portion of the base 132 and laterally beyond the channel 123 to approximately the outer edges of the elongated member 122 (FIG. 2). The arm member 134 is positioned on the top rail 137, and a threaded member 138 is threadedly engaged through the arm member 134 and the top rail 137 to secure the arm member 134 and the top rail 137 in position on the base 132 (FIGS. 2 and 7).

In operation, the left front coupling assembly 130*a* is engaged with the left front leg 104 of the ladder 102 by positioning the base 132 into the channel 123 of the left elongated member 122. The left front leg 104 is also placed in the channel 123 and is engaged against the base 132. The locking member 136 and the side rail 135 are engaged against the left front leg 104, and the threaded member 138 is tightened, thereby clamping the left front coupling assembly 130*a* to the channel 123 and securing the left front leg 104 into position in the channel 123. More specifically, the side rail 135 is engaged against the left front leg 104, clamping the leg 104 against the side of the channel 123 and preventing lateral movement of the leg 104 within the channel 123. The locking member 134 is engaged with the leg 104, preventing the leg from lifting out of the channel 123. The base 132, the arm member 134, and the locking member 136 cooperate to prevent the leg 104 from moving longitudinally along the length of the channel 123.

Similarly, the left rear coupling assembly 140*a* includes a slotted base 142 adapted to slideably engage into the channel 123 (FIG. 3), and an arm member 144 slideably coupled to the base 142. A locking member 146 is coupled to the arm member 144 and projects outwardly therefrom (FIG. 6). A side rail 145 projects outwardly from the base 142 along the length of the channel 123. A top rail 147 is engaged over the base 142 and extends laterally beyond the channel 123 to approximately the outer edges of the elongated member 122 (FIG. 3). A threaded member 148 secures the arm member 144 and the top rail 147 in position on the base 142 (FIGS. 2 and 7).

The operation of the rear coupling assembly 140*a* is similar to the operation of the front coupling assembly 130*a* described above. In brief, the left rear leg 108 is positioned in the channel 123, and the base 142 is engaged into the channel 123 and abutted against the left rear leg 108. The side rail 145 is engaged against the left rear leg 108, clamping the leg 108 against the side of the channel 123 and preventing lateral movement of the leg 108 within the channel 123. The locking member 144 is engaged with the left rear leg 108, preventing the leg from lifting out of the channel 123. The base 142, the arm member 144, and the locking member 146 cooperate to prevent the leg 108 from moving longitudinally along the length of the channel 123 of the elongated members 122, 124 (FIGS. 1 and 2).

Figure 8:
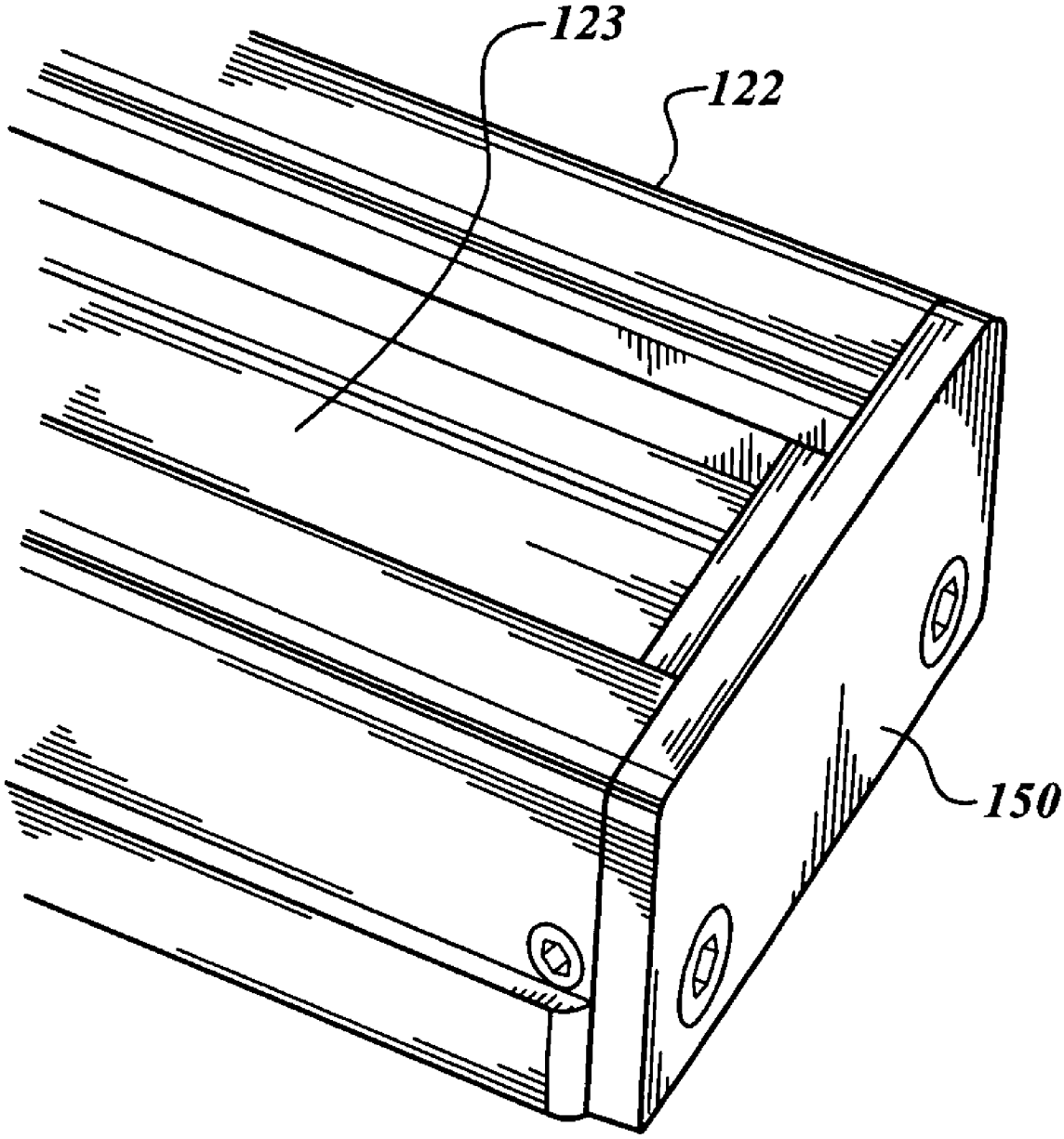
FIG. 8 is an enlarged isometric view of a channel end cap of the ladder support assembly of FIG. 1.

FIG. 8 is an enlarged isometric view of a channel end cap 150 of the ladder support assembly 120 of FIG. 1. After the front and rear leg coupling assemblies 130, 140 are installed into the channel 123 of the first and second elongated members 122, 124, the channel end cap 150 is secured at each end of the elongated members 122, 124 (two visible in FIG. 1).

With the ladder support assembly 120 coupled to the ladder 102, the ladder 102 may be utilized on a variety of non-uniform support surfaces. For example, as shown in FIG. 1, because the ladder 102 is supported by the elongated members 122, 124, the ladder 102 may be used over a plurality of floor beams 126. Of course, it will be appreciated that the ladder support assembly 120 provides a stable support that enables the ladder 102 to be utilized on a variety of non-uniform support surfaces, and is not limited to the specific floor-beam example shown in FIG. 1.

Embodiments of ladder support assemblies in accordance with the present invention may provide significant advantages over the prior art. For example, since the support assembly is clampably coupled to the ladder using the front and rear coupling assemblies 130, 140, there is no need to permanently modify the ladder to utilize the advantages of the ladder support assembly. Also, the support assembly may be easily coupled to, and uncoupled from, the ladder as needed. Because the support assembly may be easily removed from the ladder, the ladder may be easily converted back for normal use, and may be folded up readily in the usual fashion for storage. These and other advantages may be achieved using embodiments of ladder support assemblies in accordance with the present invention.

Figure 9:
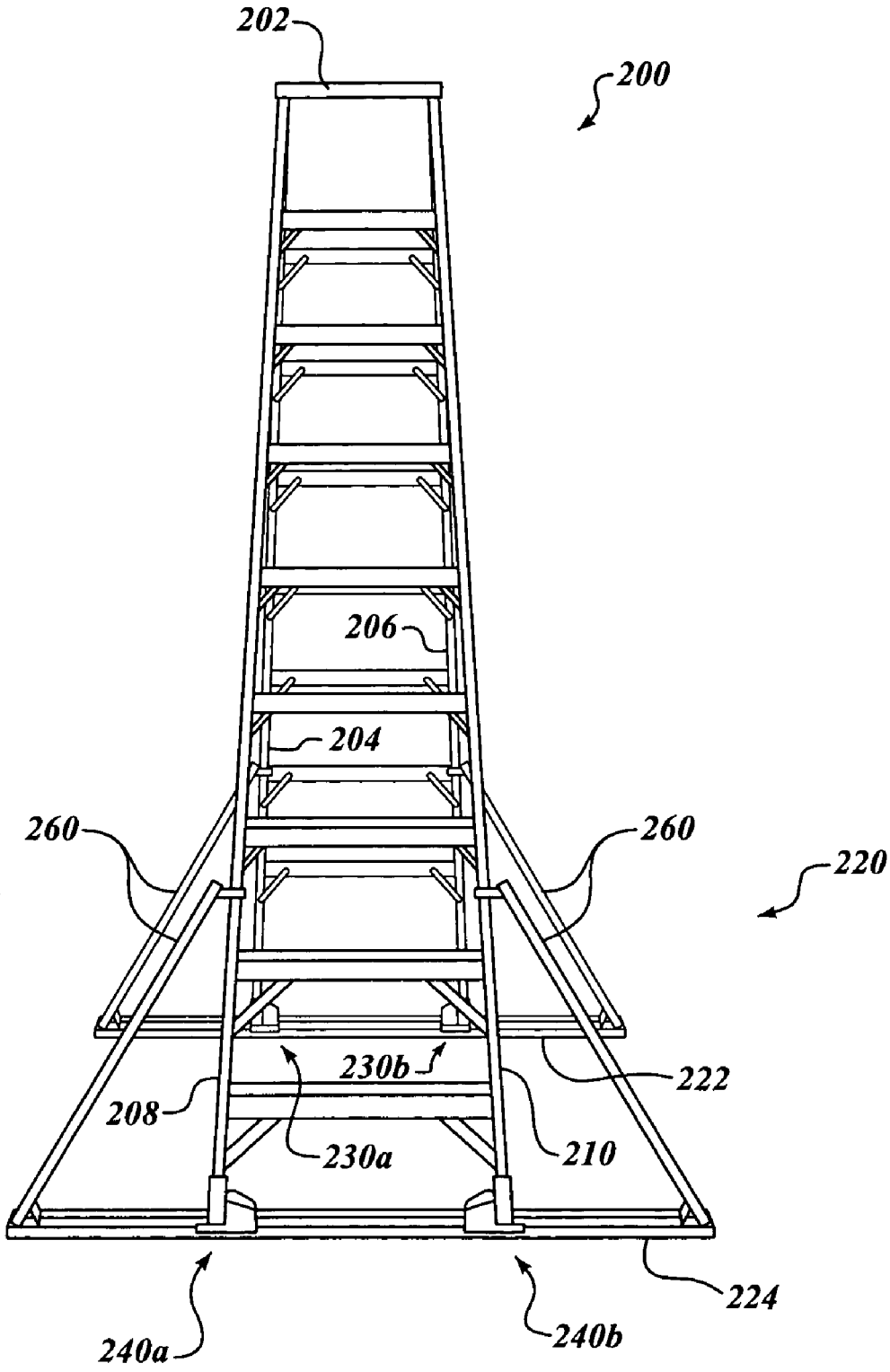
FIG. 9 is an isometric view of a ladder assembly in accordance with an alternate embodiment of the present invention.

FIG. 9 is an isometric view of a ladder assembly 200 in accordance with an alternate embodiment of the present invention. In this embodiment, the ladder assembly 200 includes a ladder 202 and a ladder support assembly 220. The ladder support assembly 220 includes front and rear transverse members 222, 224 that span transversely between and beyond the left and right front legs 204, 206, and between and beyond the left and right rear legs 208, 210, respectively. The front transverse member 222 is coupled to the front legs 204, 206 using front coupling assemblies 230*a*, 230*b*. Similarly, the rear transverse member 224 is coupled to the rear legs 208, 210 using rear coupling assemblies 240*a*, 240*b*. Side brace assemblies 260 brace the outer portions of the front and rear transverse members 222, 224.

Figure 10:
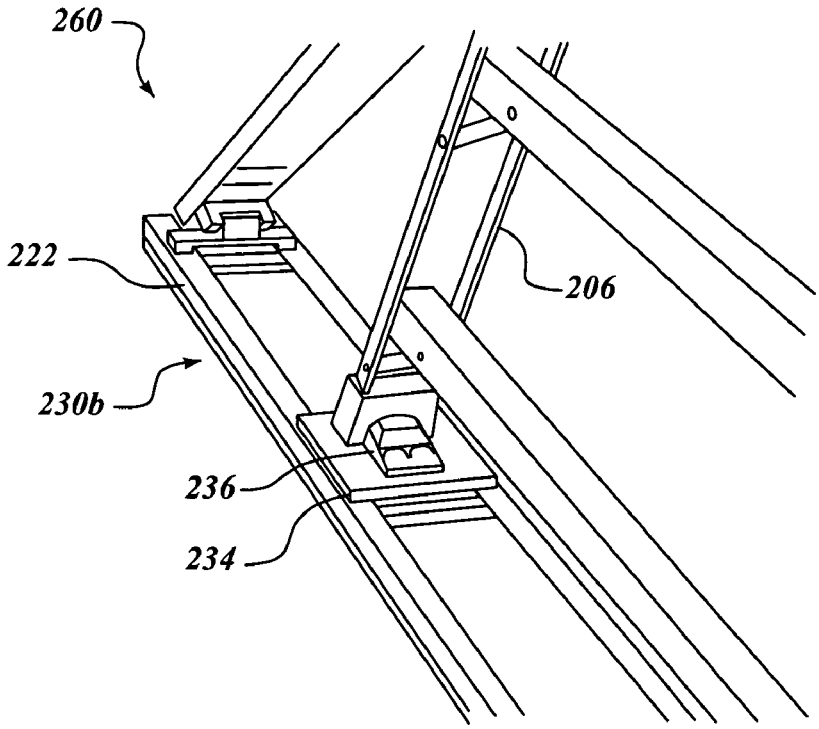
FIG. 10 is an enlarged first isometric view of a clamping assembly of the ladder support assembly of FIG. 9.
Figure 11:
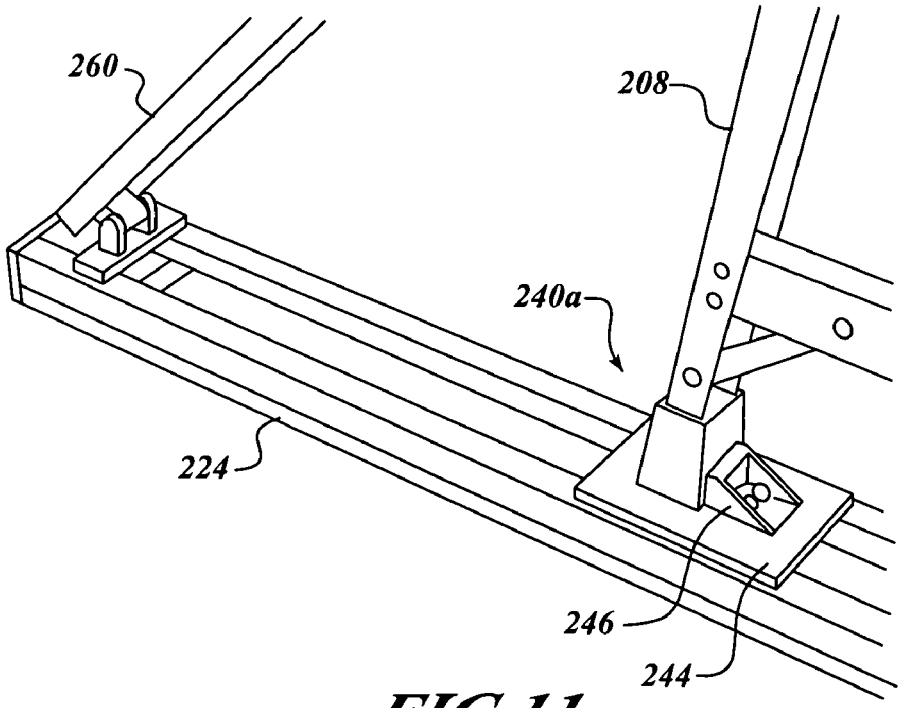
FIG. 11 is an enlarged second isometric view of the clamping assembly of the ladder support assembly of FIG. 9.
Figure 12:
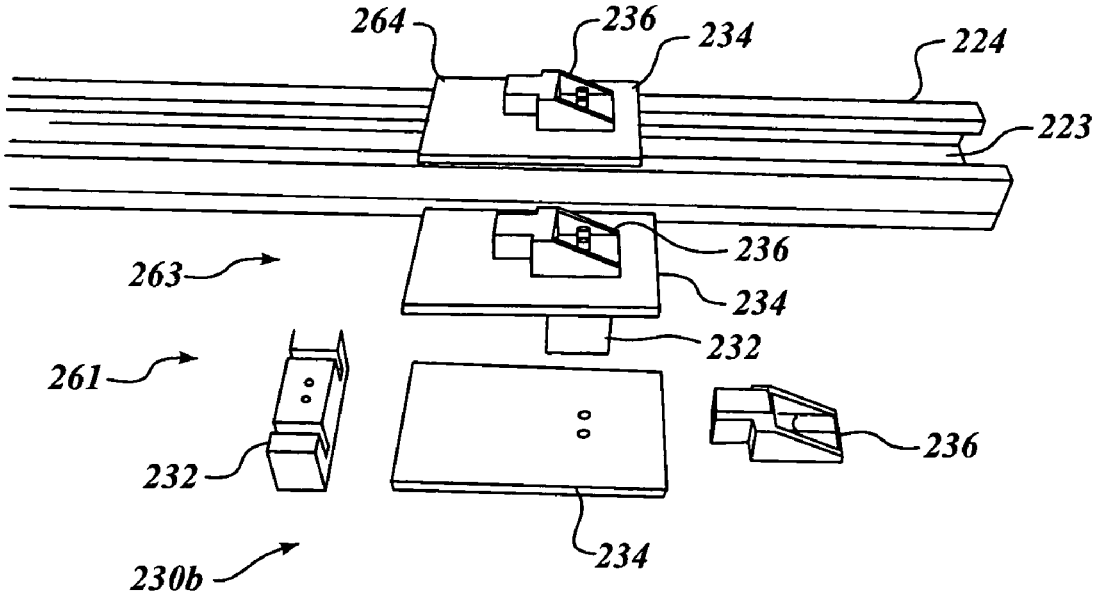
FIG. 12 is an exploded view, a partially-exploded view, and an assembled view of one of the front coupling assemblies of FIG. 9.

FIGS. 10 and 11 are enlarged isometric views of front and rear coupling assemblies 230*b*, 240*a* of the ladder support assembly 220 of FIG. 9. FIG. 12 is an exploded view 261, a partially-exploded view 263, and an assembled view 264 of the front coupling assembly 230*b* of FIG. 9. In this embodiment, the front coupling assembly 230*b* includes a slotted base 232 adapted to slideably engage into a channel 223 of the front transverse member 222, a support plate 234 coupled to the slotted base 232, and a locking member 236 coupled to the support plate 234.

As shown in FIGS. 10 and 12, in operation, the slotted base 232 is engaged into the channel 223, and the support plate 234 is coupled to the slotted base 232 and positioned on an upper portion of the front transverse member 222, spanning across the channel 223. Finally, the locking member 236 is coupled to the support plate 234 and engaged with the front leg 206 of the ladder 202 (FIG. 10). Thus, the locking member 236 of the front coupling assembly 230*b* securely engages the front leg 206, thereby coupling the ladder 202 to the front transverse member 222. Similarly, as best shown in FIG. 11, the rear coupling assembly 240*a* includes a slotted base 242 (not visible), a support plate 244, and a locking member 246. The components of the rear coupling assembly 240*a* are assembled in the same manner as the components of the front coupling assembly 230*b*, and securely engage the rear leg 208 of the ladder 202 with the rear transverse member 224.

Figure 13:
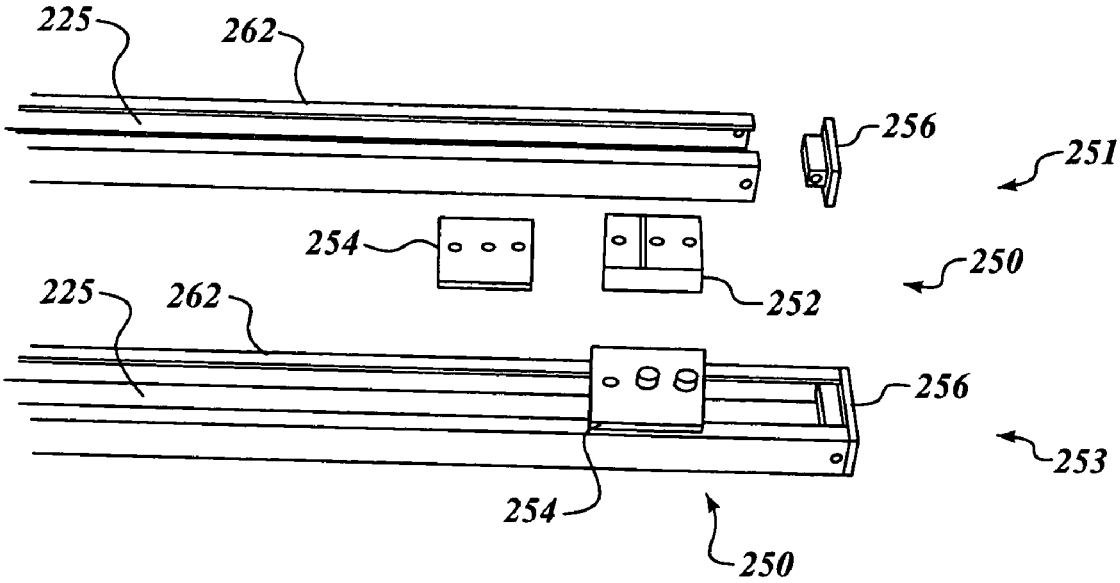
FIG. 13 is an exploded view and an assembled view of a strut assembly of the ladder support assembly of FIG. 9

FIG. 13 is an exploded view 251 and an assembled view 253 of one end of a strut assembly 250. The strut assembly is part of the side brace assembly 260 of FIG. 9. In this embodiment, the strut assembly 250 includes a strut member 262, a joint base 252 (two required per strut member) that slidably engages into a strut channel 225, and a top plate 254 that engages with the joint base 252. In the assembled position 253, the upper portion of the strut member 262 is clamped between the top plate 254 and the joint base 252. A complete assembly 253 is positioned on each end of the strut member 262. A channel stop block 256 is coupled to each end portion of a strut member 262. In this embodiment two strut assemblies 250 are employed per transverse members 222, 224 (FIG. 9).

Figure 14:
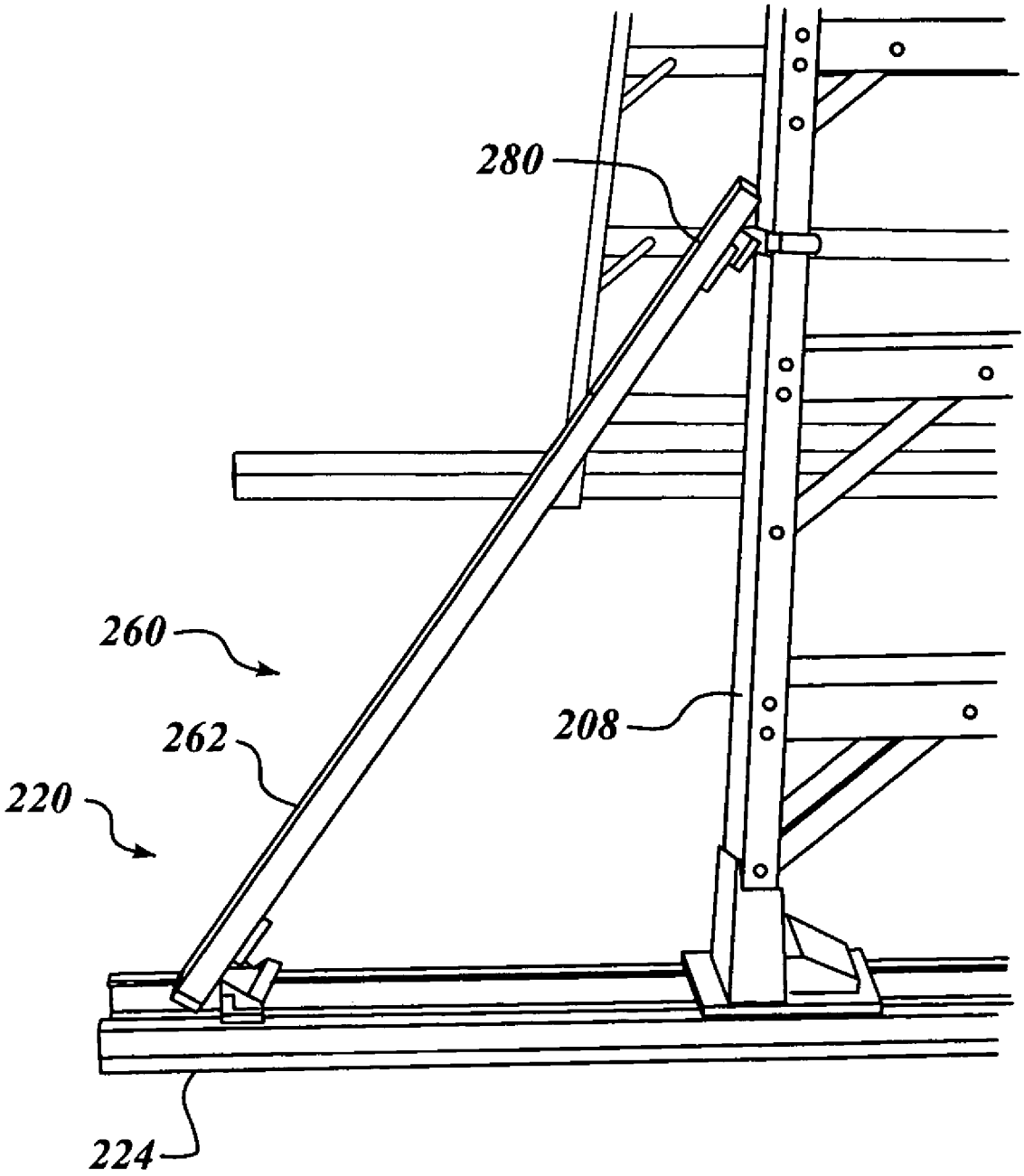
FIG. 14 is an enlarged elevational view of a side brace assembly of the ladder support assembly 220 of FIG. 9.
Figure 15:
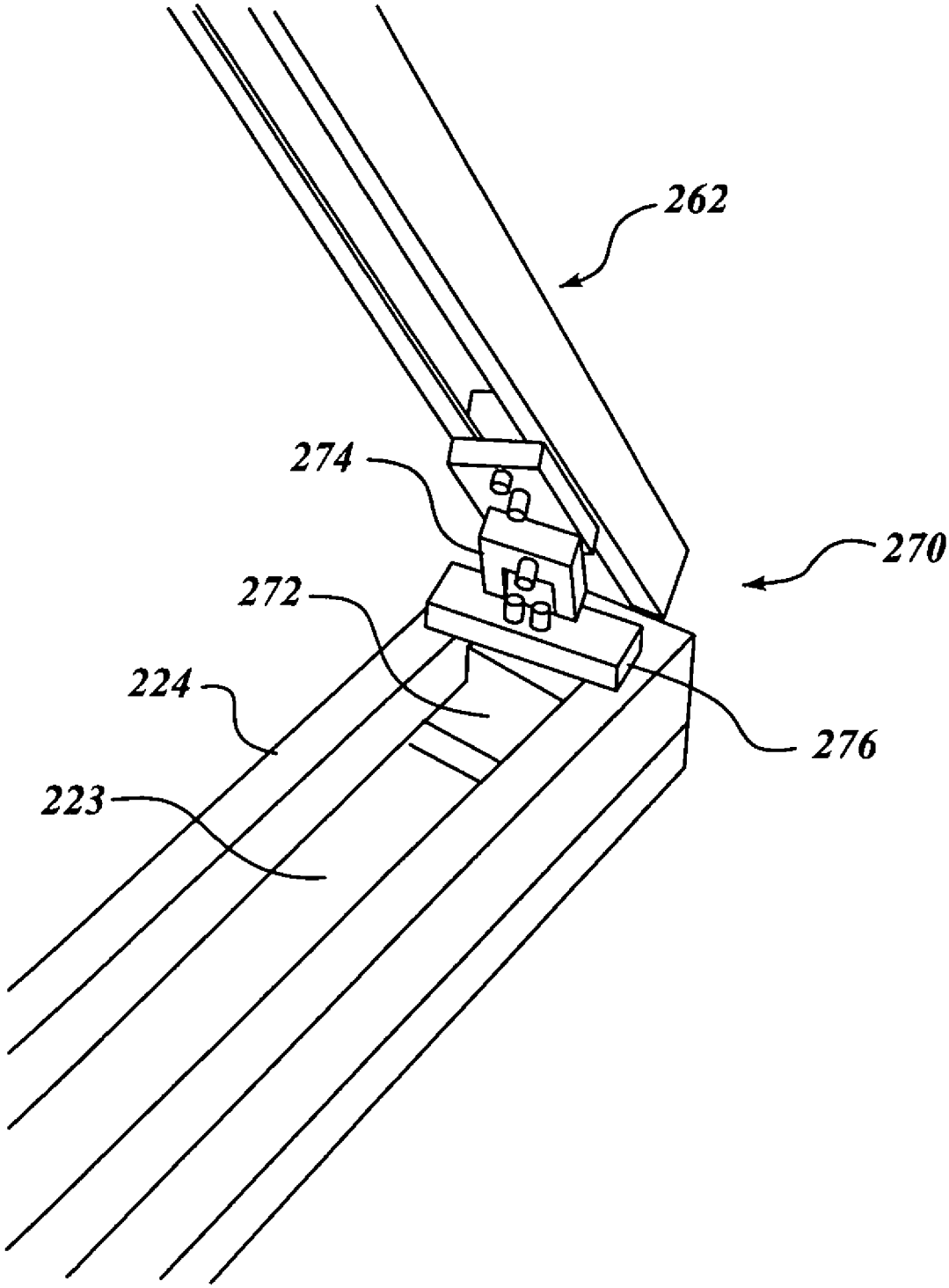
FIG. 15 is an enlarged isometric view of a lower brace coupling assembly of the side brace assembly of FIG. 14.
Figure 16:
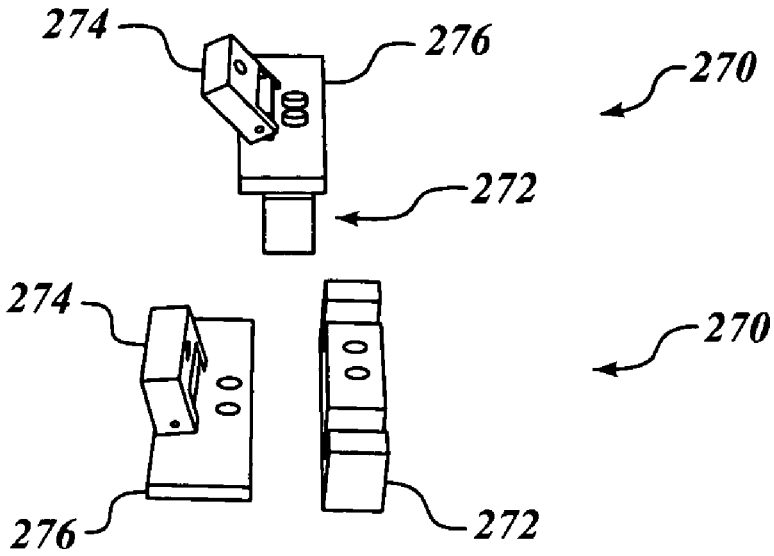
FIGS. 16 and 17 are exploded and assembled views of the lower and upper brace coupling assemblies of FIG. 15.
Figure 17:
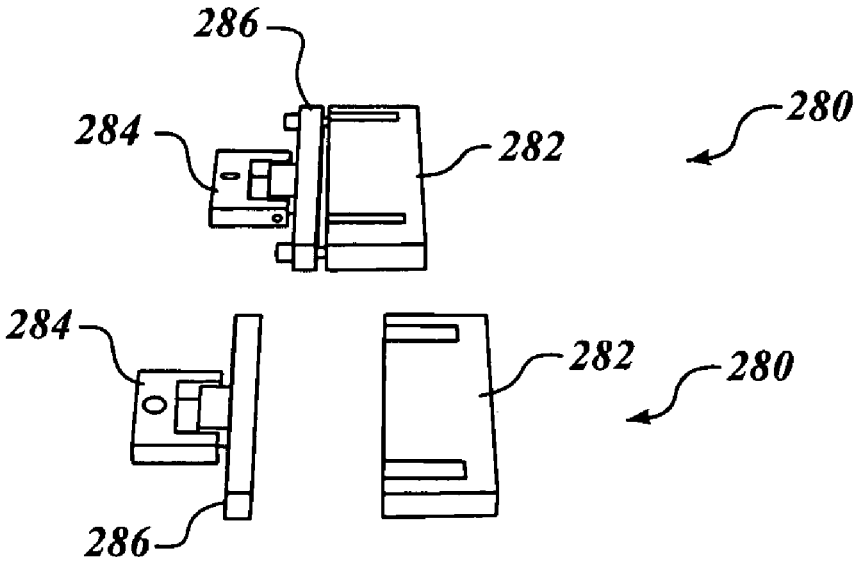

FIG. 14 is an enlarged elevational view of a side brace assembly 260 of the ladder support assembly 220 of FIG. 9. FIG. 15 is an enlarged isometric view of a lower brace coupling assembly 270 of the side brace assembly 260 of FIG. 14. FIGS. 16 and 17 are exploded and assembled views of the lower and upper brace coupling assemblies 270, 280 of FIG. 15. As best shown in FIG. 14, in this embodiment, the side brace assembly 260 includes a strut member 262 that is coupled to the rear transverse member 224 by the lower brace coupling assembly 270, and to the left rear leg 208 of the ladder 202 by the upper brace coupling assembly 280. As shown in FIG. 9, the ladder support assembly 220 may include four side brace assemblies 260. One skilled in the art will appreciate that the side braces shown in FIG. 9 protect the cantilevered portions of the transverse members 222, 224 from bending under load. Transverse members of heavier cross section might not require side braces, but at the cost of increased weight.

Referring to FIGS. 15 and 16, the lower brace coupling assembly 270 includes a slotted base 272 that engages into the channel of the transverse member 224. A coupling tab 274 is hingeably coupled to a clamp plate 276 which, in turn, is coupled to the slotted base 272. In operation, the clamp plate 276 and the slotted base 272 cooperate to clampably secure the lower brace coupling assembly 270 to the transverse member 224. The coupling tab 274 is coupled to a strut top plate of the strut member 262. In one particular embodiment, the strut member 262 is coupled to the coupling tab 274 such that it may rotate with respect to the coupling tab 274 and provide an additional degree of freedom to account for the compound angle at which the strut typically meets the transverse member.

The construction of the upper brace assembly 280 is similar to the lower brace assembly 270. As shown in FIG. 17, the upper brace assembly 280 includes a slotted base 282 that is engaged with the rear leg 208 of the ladder 202 (FIG. 14). A coupling tab 284 is hingeably coupled to a clamp plate 286. In operation, the clamp plate 286 and the slotted base 282 cooperate to clampably secure the upper brace coupling assembly 280 to the rear leg 208, and the coupling tab 284 is coupled to a strut top plate of the strut member 262. Again, in one embodiment, the brace member 262 is rotatably coupled to the coupling tab 284 to provide an additional degree of freedom to account for the compound angle at which the strut typically meets the ladder.

It will be appreciated that the ladder support assembly 220 described above with reference to FIGS. 9–17 advantageously expands the manner in which the ladder 202 may be used over non-uniform surfaces. For example, because the front and rear transverse members 222, 224 extend between and beyond the front and rear legs, respectively, the ladder 202 may be used in a different direction over the plurality of floor beams 126 shown in FIG. 1. More specifically, the ladder support assembly 220 enables the ladder 202 to be used with the ladder "facing" the interior wall 103 of the aircraft. This allows a user to perform necessary operations on the interior wall 103 without twisting the user's body or requiring the user to stand "sideways" on the ladder 202. Thus, the above-noted advantages of ladder support assemblies in accordance with the present invention may be achieved in an alternate embodiment that permits the ladder 202 to be utilized in a direction that faces along or approximately parallel with the plurality of floor beams 126, thereby improving the versatility of the ladder 202.

While preferred and alternate embodiments of the invention have been illustrated and described, as noted above, many changes can be made without departing from the spirit and scope of the invention. Accordingly, the scope of the invention is not limited by the disclosure of the preferred and alternate embodiments. Instead, the invention should be determined entirely by reference to the claims that follow.

What is claimed is:

1. A support assembly adapted for use with a ladder, comprising:

at least one elongated member adapted to extend between first and second legs of the ladder when the ladder is positioned in an operating position, the at least one elongated member having a channel disposed therein for receiving the first and second legs; and first and second coupling assemblies coupled to the elongated member at first and second positions on the elongated member, the first and second positions being spaced apart, wherein the first and second coupling assemblies are adapted to be removably and clampably coupled to the first and second legs of the ladder, respectively, wherein the channel comprises an elongated channel having a bottom surface and a pair of lateral side surfaces, and wherein at least one of the first and second coupling assemblies includes; a base adapted to slidably engage into the channel, the base including a rail member projecting outwardly from the base along a length of the channel and adapted to be engaged against a lateral surface of an associated one of the first and second legs; and a support plate coupled to the base and including a locking member projecting outwardly from the support plate and adapted to be engaged against a second lateral surface of the associated one of the first and second legs, wherein the base and the support plate are adapted to cooperate to clampably couple the associated one of the first and second legs to the at least one elongated member such that the rail member clampably engages the associated one of the legs against one of the lateral side surfaces of the channel and such that the locking member clampably engages the associated one of the legs against the bottom surface of the channel.

2. The support assembly of claim 1, wherein the elongated member is further adapted to extend beyond the first and second legs of the ladder.

3. The support assembly of claim 1, wherein the first and second coupling assemblies are slidably repositionable anywhere along a length of the at least one elongated member.

4. A support assembly adapted for use with a ladder, comprising:

first and second elongated members, the first elongated member being adapted to extend between a first pair of legs of the ladder and the second elongated member being adapted to extend between a second pair of legs of the ladder when the ladder is positioned in an operating position, wherein the first and second elongated members each have a channel disposed therein for receiving the first and second pairs of legs, respectively;

a first pair of coupling assemblies coupled to the first elongated member at spaced-apart positions on the first elongated member; and a second pair of coupling assemblies coupled to the second elongated member at spaced-apart positions on the second elongated member, wherein the first and second pairs of coupling assemblies are adapted to be removably and clampably coupled to the first and second pairs of legs of the ladder, respectively, wherein the channel comprises an elongated channel having a bottom surface and a pair of lateral side surfaces, and wherein at least one of the coupling assemblies includes; a base adapted to slidably engage into an associated channel, the base including a rail member projecting outwardly from the base along a length of the associated channel and adapted to be engaged against a lateral surface of an associated one of the legs; and a support plate coupled to the base and including a locking member projecting outwardly from the support plate and adapted to be engaged against a second lateral surface of the associated one of the legs, wherein the base and the support plate are adapted to cooperate to clampably couple the associated one of the legs to the at least one elongated member such that the rail member clampably engages the associated one of the legs against one of the lateral side surfaces of the associated channel and such that the locking member clampably engages the associated one of the legs against the bottom surface of the associated channel.

5. The support assembly of claim 4, wherein the first and second elongated members are further adapted to extend beyond the first and second pairs of legs, respectively.

6. The support assembly of claim 4, wherein the first and second pairs of coupling assemblies are slidably repositionable anywhere along a length of the first and second elongated members, respectively.

7. A ladder assembly, comprising:

a ladder having first and second pairs of legs and being adapted to be positioned in an operating position suitable for supporting a user; and a ladder support assembly, including:

first and second elongated members, the first elongated member extending between the first pair of legs and the second elongated member extending between the second pair of legs when the ladder is positioned in the operating position, the first and second elongated members each having a channel disposed therein for receiving the first and second pairs of legs respectively;

a first pair of coupling assemblies coupled to the first elongated member at spaced-apart positions on the first elongated member; and a second pair of coupling assemblies coupled to the second elongated member at spaced-apart positions on the second elongated member, wherein the first and second pairs of coupling assemblies are adapted to be removably and clampably coupled to the first and second pairs of legs of the ladder, respectively, wherein the channel comprises an elongated channel having a bottom surface and a pair of lateral side surfaces, and wherein at least one of the coupling assemblies includes; a base adapted to slidably engage into an associated channel, the base including a rail member projecting outwardly from the base along a length of the associated channel and adapted to be engaged against a lateral surface of an associated one of the legs; and a support plate coupled to the base and including a locking member projecting outwardly from the support plate and adapted to be engaged against a second lateral surface of the associated one of the legs, wherein the base and the support plate are adapted to cooperate to clampably couple the associated one of the legs to the at least one elongated member such that the rail member clampably engages the associated one of the legs against one of the lateral side surfaces of the associated channel and such that the locking member clampably engages the associated one of the legs against the bottom surface of the associated channel.

8. The ladder assembly of claim 7, wherein the first and second elongated members are further adapted to extend beyond the first and second pairs of legs, respectively, when the ladder is positioned in the operating position.

9. The ladder assembly of claim 7, wherein the first and second pairs of coupling assemblies are slidably repositionable anywhere along a length of the first and second elongated members, respectively.

* * * * *